US006097263A

United States Patent [19]

Mueller et al.

[11] Patent Number: 6,097,263

[45] Date of Patent: Aug. 1, 2000

[54] METHOD AND APPARATUS FOR ELECTRICALLY TUNING A RESONATING DEVICE

[75] Inventors: Carl H. Mueller, Lakewood; Zhihang Zhang, Westminster; Gerhard A. Koepf, Boulder, all of Colo.

[73] Assignee: Robert M. Yandrofski

[21] Appl. No.: 08/884,362

[22] Filed: Jun. 27, 1997

Related U.S. Application Data

[60] Provisional application No. 60/020,766, Jun. 28, 1996.

[51] Int. Cl.[7] ..... H01P 7/10

[52] U.S. Cl. ..... 333/17.1; 333/219.1; 333/235; 333/99 S; 505/210; 505/701; 505/866

[58] Field of Search ..... 333/219.1, 227, 333/231, 235, 99 S, 17.1; 505/210, 700, 701, 866

[56] References Cited

U.S. PATENT DOCUMENTS

| | | | |
|---|---|---|---|
| 3,365,400 | 1/1968 | Pulvari . | |
| 3,569,795 | 3/1971 | Gikow . | |
| 3,784,937 | 1/1974 | Jackson et al. | 333/24 C |
| 4,161,766 | 7/1979 | Castleberry et al. | 361/280 |
| 4,837,536 | 6/1989 | Honjo | 333/247 |
| 5,070,241 | 12/1991 | Jack | 250/336.2 |
| 5,105,200 | 4/1992 | Koepf | 343/700 |
| 5,142,437 | 8/1992 | Kammerdiner et al. | 361/313 |
| 5,146,299 | 9/1992 | Lampe et al. | 357/23.5 |
| 5,192,871 | 3/1993 | Ramakrishnan et al. | 257/595 |
| 5,208,213 | 5/1993 | Ruby | 505/210 |
| 5,212,463 | 5/1993 | Babbitt et al. | 333/161 |
| 5,307,033 | 4/1994 | Koscica et al. | 333/161 |
| 5,309,166 | 5/1994 | Collier et al. | 343/778 |
| 5,312,790 | 5/1994 | Sengupta et al. | 501/137 |
| 5,358,926 | 10/1994 | Olson et al. | 505/210 |
| 5,409,889 | 4/1995 | Das | 505/210 |
| 5,459,123 | 10/1995 | Das | 505/210 |
| 5,472,935 | 12/1995 | Yandrofski et al. | 505/210 |
| 5,496,795 | 3/1996 | Das | 505/210 |
| 5,496,796 | 3/1996 | Das | 505/210 |
| 5,523,283 | 6/1996 | Simon et al. | 505/239 |
| 5,538,941 | 7/1996 | Findikoglu et al. | 505/210 |
| 5,589,845 | 12/1996 | Yandrofski et al. | 343/909 |
| 5,640,042 | 6/1997 | Koscica et al. | 257/595 |

FOREIGN PATENT DOCUMENTS

| | | | |
|---|---|---|---|
| 2042-787 | 2/1990 | Japan | H05K 1/03 |
| 3-205904 | 9/1991 | Japan | H01P 9/00 |
| 5-29809 | 5/1993 | Japan | H01P 3/08 |
| 1352562 A1 | 6/1984 | U.S.S.R. | H01P 1/18 |
| 1177-869 | 9/1985 | U.S.S.R. | H01P 1/185 |
| 1193-738 | 11/1985 | U.S.S.R. | H01P 1/18 |
| 1224868 | 11/1985 | U.S.S.R. | H01P 3/20 |

OTHER PUBLICATIONS

Beall, James A., Ronald H. Ono, David Galt and John C. Price; Tunable High Temperature Superconductor Microstrip Resonators; To appear in the 1993 IEEE MTT–S International Microwave Symposium Digest.

Vendik, O.G., L.T. Ter–Martirosyan, A.I. Dedyk, S.F. Karmanenko and R.A. Chakalov; High–$T_c$ Superconductivity: New Applications of Ferroelectrics at Microwave Frequencies: Ferroelectrics, 1993, vol. 144, pp. 33–43.

Barnes, Frank S., John Price, Allen Hermann, Zhihang Zhang, Huey–Daw Wu, David Galt, Ali Naziripour; Some Microwave Applications of $BaSrTiO_3$ and High Temperature Superconductors; Integrated Ferroelectrics; 1995; vol. 8, pp. 171–184.

(List continued on next page.)

*Primary Examiner*—Benny T. Lee
*Attorney, Agent, or Firm*—Sheridan Ross P.C.

[57] ABSTRACT

The present invention provides an electronically tunable resonating apparatus which uses a tunable dielectric material which is biased by an electric field to alter the resonant frequency in a resonating cavity. The electrodes which apply the electric field are connected to a variable voltage source. The electrodes can therefore apply a plurality of electric field strengths and provide a range of resonant frequencies in the resonating apparatus. The resonating apparatus is particularly useful for microwave and millimeterwave electromagnetic energy.

29 Claims, 10 Drawing Sheets

OTHER PUBLICATIONS

Edited by M.J. Howes and D.V. Morgan; Variable Impedance Devices; 1978; pp. 270–275.
Mortenson, Kenneth E.; Variable Capacitance Diodes; 1990: pp. 44–48.
Scott, J.F., David Galt, John C. Price, James A. Beall, Ronald H. Ono, Carlos A. Paz de Araujo and L.D. McMillan; A Model of Voltage–Dependent Dielectric Losses for Ferroelectric MMIC Devices; Integrated Ferroelectrics; 1995; vol. 6; pp. 189–203.
Vendik, Orest, Igor Mironenko and Leon Ter–Martirosyan; Superconductors Spur Application of Ferroelectric Films; Microwaves and RF; 1994; pp. 67–70.
Jeck, M., S. Kolesov, A. Kozyrev, T. Samoilova, and O. Vendik; Investigation of Electrical Nonlinearity of HTS Thin Films as Applied to Realization of a Microwave IC Mixer; Jounral of Superconductivity; vol. 8, No. 6, 1995; pp. 705–714.
Galt, David, John C. Price; James A. Beall, Ronald H. Ono; Characterization of a Tunable Thin Film Microwave $Yba_2Cu_3O_{7-x}$/$SrTio_3$Coplanar Capacitor; Appl. Phys. Lett 63 (22); Nov. 29, 1993; pp. 3078–3080.
Galt, David, John C. Price; James A. Beall, Todd E. Harvey; Ferroelectric Thin Film Characterization Using Superconducting Microstrip Resonators; IEEE Transactions on Applied Superconductivity; vol. 5, No. 2; Jun. 1995; pp. 2575–2578.
Wu, Huey–Daw, Frank S. Barnes, David Galt, John Price, James A. Beall; Dielectric Properties of Thin Film $SrTiO_3$ Grown on $LaA10_3$ With $Yba_2CU_3O_{7-x}$Electrodes; To appear in the proceeding sof the Jan. 1994 SPIE–Int. Soc. Opt. Eng. Conference on High–$T_c$ Microwave Superconductors and Applications, SPIE Proceedings vol. 2156.
Varadan, V.K., D.K. Ghodgaonkar and V.V. Varadan; Ceramic Phase Shifters for Electronically Steerable Antenna Systems; Microwave Journal; Jan. 1992; pp. 118–125.
Walkenhorst, A., C. Doughty, X.X. Xi, S.N. Mao, Q. Li, T. Venkatesan and R. Ramesh; Dielectric Properties of $SrTio_3$ Thin Films Used in High $T_c$ Superconducting Field–Effect Devices; Appl. Phys. Lett 60 (14), Apr. 6, 1992; pp. 1744–1746.
Takemoto–Kobayashi, June H., Charles M. Jackson, Emery B. Gillory, Claire Pettiette–Hall, John F. Burch; Monolithic High–Tc Superconducing Phase Shifter at 10 GHz; IEEE MTT–S Digest; 1992; pp. 469–472.
Takemoto, June H. Charles M. Jackson, Roger Hu, John F. Burch, Kenneth P. Daly and Randy W. Simon; Microstrip Resonators and Filters Using High–TC Superconducting Thin Films on $LaA10_3$; IEEE; 1991; pp. 2549–2552.
Ramesh, R., A. Inam, W.K. Chan, F. Tillerot, B. Wilkens, C.C. Chang, T. Sands, J.M. Tarasco and V.G. Keramidas; Ferroelectric $PbZr_{0.2}Ti_{0.8}O_3$ Thin Films on Epitaxial Y–Ba–Cu–O; Appl. Phys. Lett.; vol. 59, No. 27, Dec. 30, 1991; pp. 3542–3544.
Track; E.K., Z–Y Shen, H. Dang, M. Radparvar and S.M. Faris; Investigation of an Electronically Tuned 100 Ghz Superconducting Phase Shifter; IEEE; 1991.
Ryan, Paul A.; High–Temperature Superconductivity for EW and Microwave Systems; Journal of Electronic Defense; May 1990; pp. 55–59.
Dinger, Robert J., Donald R. Bowling, Anna M. Martin and John Talvacchio; Radiation Efficiency Measurements of a Thin–Film Y–Ba–Cu–O Superconducting Half–Loop Antenna at 500 Mhz; IEEE MTT–S Digest; 1991; pp. 1243–1246.
Dinger, Robert J.; Donald R. Bowling and Anna M. Martin; A Survey of Possible Passive Antenna Applications of High–Temperature Superconductors; IEEE Transactions on Microwave Theory and Techniques; vol. 39, No. 9; Sep. 1991; pp. 1498–15–7.
McAvoy, B.R., G.R. Wagner, J.D. Adam, J. Talvacchio and M. Driscoll; Superconducting Stripline Resonator Performance; Proc. 1988 Applied Superconductivity Conf. (IEEE Trans. Magn. *MAG–25*, 1989).
Howes, M.J. and D.V. Morgan (edited); Variable Impedance Devices; John Wiley & Sons; 1978; pp. 270–275.
Jackson, Charles M., June H. Kobayashi, Emery B. Guillory, Claire Pettiette–Hall, and John F. Burch; Monolithic HTS Microwave Phase Shifter and Other Devices; Journal of Superconductivity; vol. 5, No. 4, 1992; pp. 419–424.
Das, S.N.; Ferroelectrics for Time Delay Steering of an Array; Ferroelectrics; 1973; vol. 5, pp. 253–257.
Jackson, Charles M., June H. Kobayashi; Alfred Lee; Claire Pettiette–Hall, John F. Burch, Roger Hu, Rick Hilton, and Jim McDade; Novel Monolithic Phase Shifter Combining Ferroelectrics and High Temperature Superconductors; Microwave and Optical Technology Letters; vol. 5, No. 14; Dec. 20, 1992; pp. 722–726.
Jackson, C.M., J.H. Kobayashi, D. Durand and A.H. Silver; A High Temperature Superconductor Phase Shifter; Microwave Journal; Dec. 1992; pp. 72–78.

FIG. 4
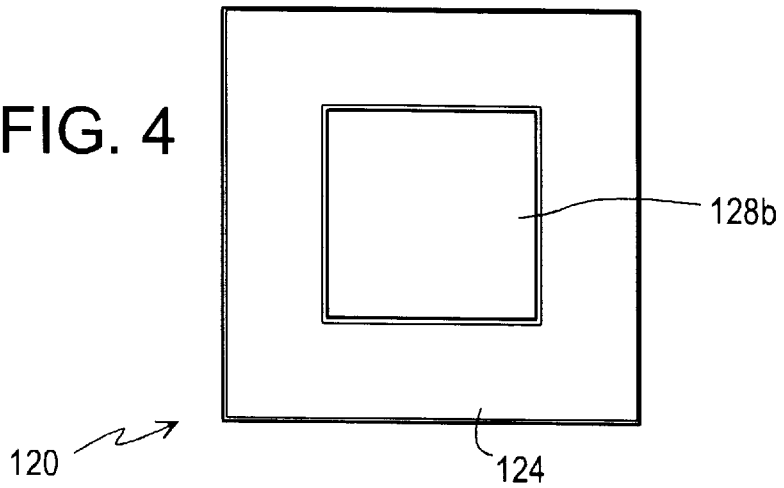
FIG. 5
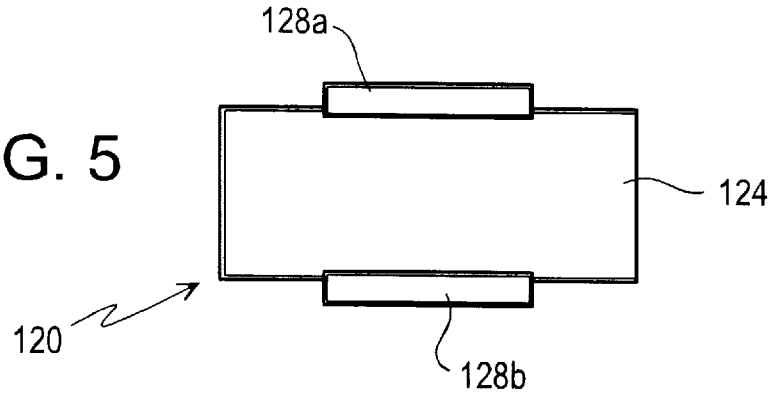
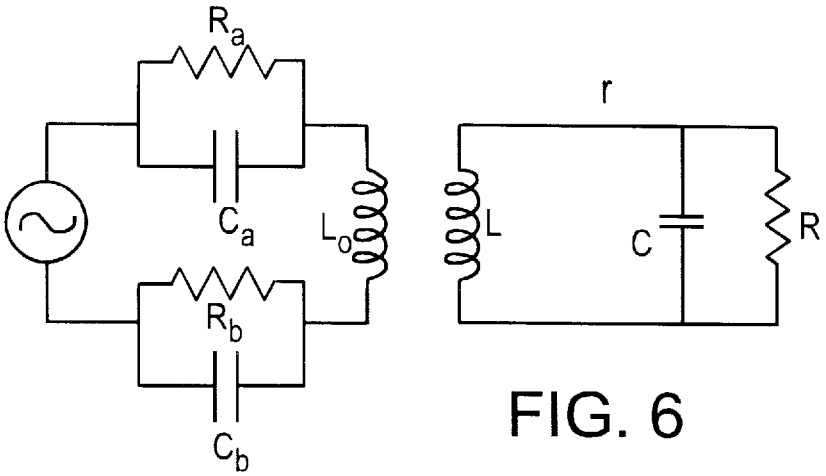
FIG. 6

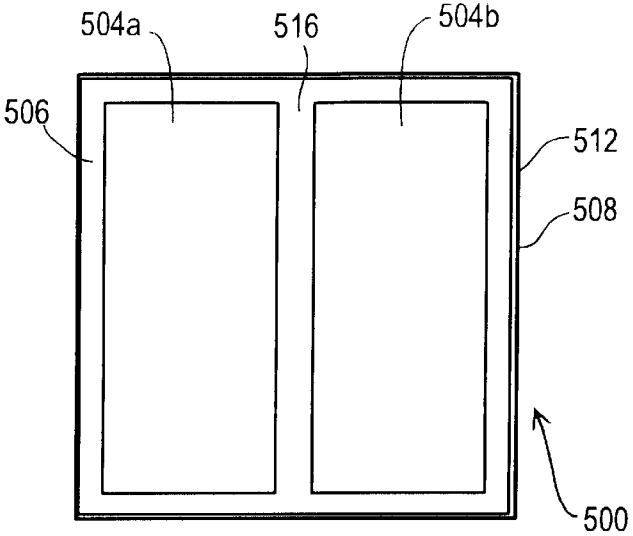
FIG. 13
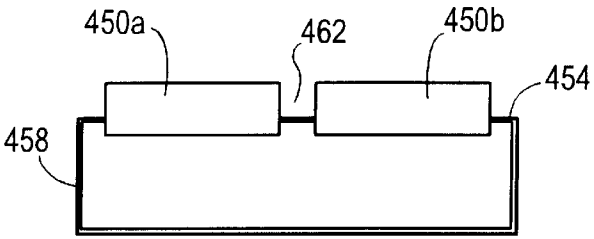
FIG. 14
FIG. 15
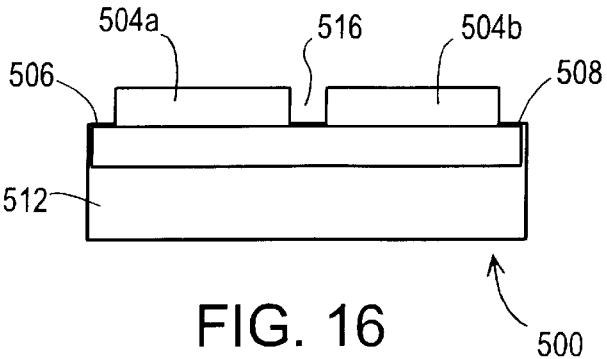
FIG. 16

METHOD AND APPARATUS FOR ELECTRICALLY TUNING A RESONATING DEVICE

CROSS-REFERENCE TO RELATED APPLICATIONS

The present application claims priority from U.S. Provisional application Ser. No. 60/020,766, filed Jun. 28, 1996, entitled "NEAR RESONANT CAVITY TUNING DEVICES", which is incorporated herein by reference in its entirety.

FIELD OF THE INVENTION

The present invention relates generally to tunable resonating cavities and particularly to electronically tunable microwave and millimeterwave cavities.

BACKGROUND OF THE INVENTION

Dielectric resonating cavities are components of filters, reflection-type amplifiers, and oscillators. A dielectric resonating cavity refers to a space bounded by an electrically conducting surface in which oscillating electromagnetic energy is stored. Resonating cavities are typically rectangular or cylindrical in shape with conducting side walls and an input and output couple for electromagnetic energy. Dielectric blocks or pucks may be positioned in the cavity to provide a desired resonant frequency of the resonating cavity (i.e., the cavity resonant frequency). The desired cavity resonant frequency determines the frequency characteristics of the electromagnetic energy output by the cavity.

The cavity resonant frequency is determined by the resonant mode and dimensions of the resonating cavity and the electric permittivity of the dielectric block or puck located in the cavity. The cavity resonant frequency can vary in response to thermal expansion/contraction of the resonating cavity, thermally induced fluctuations in the electric permittivity of the dielectric block or puck, and/or dimensional tolerances of the resonating cavity and its placement in the circuit.

One method for fine tuning a cavity in response to fluctuations in the cavity resonant frequency is to use a metal or dielectric material to selectively perturb the electromagnetic energy distribution in the resonating cavity. Typically, this is accomplished either by manually or mechanically turning a number of tuning screws in the cavity or by altering the position or shape of the dielectric block or puck in the cavity. This method can have a slow tuning speed, a low degree of tuning precision, and, for mechanical tuning, a high rate of mechanical problems.

Another method for fine tuning a cavity is to alter the permeability of a ferromagnetic or ferrimagnetic material, such as yttrium iron garnet, located in the cavity. The permeability is controlled by controlling the strength of a magnetic field applied to the material. This method can have a slow tuning speed, a high hysteresis loss (especially at frequencies used for cellular and Personal Communications Systems (PCS) wireless system), and a permeability that is strongly dependent upon temperature fluctuations. An additional problem which limits the use of ferrite tuning is that the magnetic field used to tune a first cavity often has an adverse effect on other adjacent cavities located in close proximity to the first cavity.

Yet another method for fine tuning a cavity is to couple a semiconductor varactor to the electromagnetic energy in the cavity. Altering the capacitance of the varactor results in a change in the cavity's resonant frequency. Semiconductor varactors are rarely used at microwave or higher frequencies because such varactors can result in a high insertion loss and generate spurious signals at undesired frequencies. In signal transmission applications, the voltage and/or current breakdown strengths of semiconducting varactors can be exceeded when the power level of the cavity exceeds approximately one milliwatt. Filters used for signal transmission typically operate in the 1 to 800 watt range.

Another method for fine tuning a cavity is to alter the capacitance of a varactor diode coupled to the cavity via a coupling loop. The diode capacitance is varied by varying the d.c. voltage applied to the diode, which changes the width of the charge depletion layer in a semiconductor. At microwave and millimeter frequencies, the diode and coupling loop can produce high microwave attenuation due to the series resistance of the semiconductor areas adjacent to the charge-depleted portion of the semiconductor. The high attenuation can result in an undesirably low Q, and thus unacceptably high loss of the electromagnetic energy input into the cavity.

SUMMARY OF THE INVENTION

It is an objective of the present invention to provide an apparatus and method for tuning a resonating cavity that provides for a cavity having a high quality factor, especially at microwave or higher frequencies. Related objectives include providing a tuning apparatus that performs effectively at high RF power levels and/or high frequencies, has a relatively low insertion loss, and/or has a relatively high voltage and/or breakdown strength.

It is a further objective to provide an apparatus and method for tuning a resonating cavity that has a relatively high tuning speed. Related objectives include providing a tuning apparatus that is electronically tunable, has a high degree of tuning precision and/or selectivity, has few, if any, moving parts, and is robust and reliable.

These and other objectives are addressed by the tunable electromagnetic resonating apparatus of the present invention. The tunable electromagnetic resonating apparatus includes: (i) a resonating cavity for resonating at a cavity resonant frequency in response to electromagnetic energy received by the resonating cavity; (ii) an input for inputting electromagnetic energy into the resonating cavity; (iii) an output for outputting electromagnetic energy from the resonating cavity; and (iv) an electronically operated tuning device coupled to the resonating cavity. The tuning device includes a dielectric material, located within the resonating cavity, having an electric permittivity that is a function of a variable voltage applied thereto and a biasing device for applying the variable voltage to the dielectric material. To maintain insertion losses low and effectively tune the cavity, the biasing device provides a dielectric capacitance of no more than about 10 picofarads across the dielectric material. The cavity resonant frequency is varied by varying the dielectric capacitance and thereby altering the electric permittivity. Because the electromagnetic energy is coupled to the tuning device, the cavity resonant frequency is impacted by the variation in the dielectric capacitance.

Relative to existing tuning devices, the tuning device has a number of distinct advantages. The tuning device can be tuned rapidly and with a high degree of precision to a selected cavity resonant frequency. The tuning device can have relatively low insertion losses and therefore the resonating cavity a relatively high Q. The tuning device can perform effectively at high RF power levels and/or high frequencies. The dielectric material can be selected to have a relatively high voltage or breakdown strength. Being electronically actuated, the tuning device has few, if any, moving parts and therefore is robust and reliable.

The electromagnetic energy suitable for the resonating apparatus can have a variety of frequencies. The preferred electromagnetic energy has a frequency that is at least that of microwave energy or a higher frequency. More preferably, the electromagnetic energy is microwave or millimeterwave energy. Microwave energy typically has a frequency ranging from about 300 to about 30,000 MHz. Millimeterwave energy typically has a wavelength ranging from about 10 mm to about 3 mm and a frequency ranging from about 30 to about 100 GHz.

The dielectric material can be any electrically insulating material for which the electric permittivity of the insulating material is altered via application of a voltage, particularly a DC voltage. The dielectric material can be a bulk(i.e., self-supporting or thick film)or thin film ferroelectric or paraelectric material. "Self-supporting bulk dielectric material" refers to a dielectric material having a thickness of at least about 50 microns and preferably no more than about 200 microns and typically manufactured by sintering, hot pressing, hydrothermal growth, or Czochralski growth techniques. Self-supporting dielectric materials are not formed on substrates. "Thick film bulk dielectric material" refers to a dielectric material having a thickness ranging from about 5 to about 100 microns and typically deposited by tape casting or slip casting techniques onto an underlying substrate. "Thin film dielectric material" refers to a dielectric material having a thickness ranging from about 0.01 to about 10 microns and typically deposited by sputtering, laser deposition, sol-gel, or chemical vapor deposition techniques onto an underlying substrate. The selection of a bulk or thin film ferroelectric or paraelectric material for a given application depends upon the cavity resonant frequency and electromagnetic field strength. Generally, the desired characteristics of the ferroelectric or paraelectric material are a high permittivity (e.g., no less than about 1,000) at room temperature, with a low loss tangent (e.g., no more than about 0.02). Preferred ferroelectric and paraelectric materials are crystalline or ceramic materials, including barium strontium titanate, $Ba_xSr_{1-x}TiO_3$, or lead zirconate titanate, $PbZr_{1-x}Ti_xO_3$, where $0 \leqq x \leqq 1$, and $LaTiO_3$, $PbZrO_3$, $LaZrO_3$l $PbMgO_3$, $PbNbO_3$, $KTaO_3$, and composites and mixtures thereof.

To alter the electric permittivity of the dielectric material, the biasing device applies an electric field to the dielectric material. The preferred strength of the electric field preferably ranges from about 0 to about 500 kv/cm.

To apply the electric field to the dielectric material, the biasing device can include positively charged and negatively charged tuning electrodes in contact with the dielectric material, a power source (e.g., a variable voltage source) which is typically located outside the cavity, and electrical leads extending from the power source to the electrodes which, along with the dielectric material, are located in the cavity. The electrodes are spaced apart from one another by a gap, thereby forming the dielectric capacitance. In one configuration, the tuning electrodes are located on a common surface of the dielectric material.

The tuning electrodes and dielectric material can be supported by a dielectric substrate having an impedance that is more than the impedance of the dielectric material to cause a greater portion of the electromagnetic energy to pass through the dielectric material than through the dielectric substrate. The dielectric substrate commonly is formed from a material that has a electric permittivity that does not vary with applied voltage, such as lanthanum aluminate ($LaAlO_3$), magnesium oxide (MgO), neodynium gallate ($NdGaO_3$) and aluminum oxide ($Al_2O_3$)

In a particularly preferred configuration, the tuning electrodes, dielectric material, and dielectric substrate are configured to define a first path for electromagnetic energy through the electrodes and the dielectric material and a second path for electromagnetic energy through the electrodes and the dielectric substrate. The first and second paths are electrically connected in parallel.

To retard losses of electromagnetic energy due to coupling of the energy to the electrical leads, the tuning device can include a leakage control device for controlling the amount of electromagnetic energy conducted by the leads. As will be appreciated, the leads are positioned in the cavity and can therefore couple to the electromagnetic energy. To reduce such coupling, the leakage control device can include a connection between the electrical leads and the tuning electrodes that is located at a voltage node. Alternatively, the leakage control device can include an RF electrical short circuit located along one or both of the leads at a distance of one quarter wavelength of the RF signal from the corresponding voltage node. By way of example, the RF short circuit can be formed by a shunt capacitor connected to one or both of the leads.

The location of the tuning device within the cavity depends upon the electromagnetic field distribution and therefore the resonant mode of the cavity. For the $TE_{01\delta}$, $HE_{11\delta}$, and $TM_{01\delta}$ resonant modes, the preferred location of the tuning device (i.e., the tuning electrodes and the dielectric material) is where the electric field portion of the electromagnetic field is greatest (i.e., in close proximity to or on the surface of the dielectric puck or block).

The tuning device can include a transmission line in electrical contact with the tuning electrodes and dielectric material. The tuning device defines a resonant circuit having a resonant frequency. The resonant frequency is altered by altering the electric permittivity of the dielectric material. The tuning device is coupled to the electromagnetic energy in the cavity and the cavity's resonant frequency is altered by altering the resonant frequency of the tuning device.

To effectively tune the resonating cavity, a control feedback loop is further provided. The control feedback loop includes: (i) a sensing device for determining the cavity resonant frequency and generating a signal in response thereto; (ii) a variable power source connected to the biasing device for applying power thereto; and (iii) a control device connected to the variable power source for receiving the signal and generating a control signal in response thereto. The variable power source applies power to the biasing device in response to the control signal.

The operation of the control feedback loop involves a number of iterative steps. By way of example, the method includes the iterative steps of: (i) applying a first electric field of a first electric field strength to the dielectric material positioned in the cavity to produce a first electric permittivity in the dielectric material; (ii) measuring a first cavity resonant frequency; (iii) selecting, based on the first cavity resonant frequency, a second electric field strength that is sufficient to produce a second cavity resonant frequency; and (iv) applying a second electric field of the second electric field strength to the dielectric material. The steps are repeated as many times as necessary to yield the selected cavity resonant frequency. The time required to produce the selected resonant frequency by this method is typically no more than about $1\times10^{-3}$ seconds.

In some applications, the method can include the additional step of comparing the selected cavity resonant frequency with a set of predetermined values for the cavity resonant frequency with corresponding electric field strengths. Based thereon, the control device selects an electric field strength. This step is particularly useful in fully automated tuning systems.

BRIEF DESCRIPTION OF THE DRAWINGS

FIG. 4 is a top view of an electronically tunable varactor according to a first embodiment of a varactor of the present invention;

FIG. 5 is a side view of the varactor of FIG. 4;

FIG. 6 is a circuit diagram of the electronically tunable dielectric resonating cavity apparatus;

FIG. 13 is a top view of an electronically tunable varactor according to a second embodiment of a varactor of the present invention;

FIG. 14 is a side view of the varactor of FIG. 13;

FIG. 15 is a top view of an electronically tunable varactor according to a third embodiment of a varactor of the present invention;

FIG. 16 is a side view of the varactor of FIG. 15;

DETAILED DESCRIPTION

Figure 1:
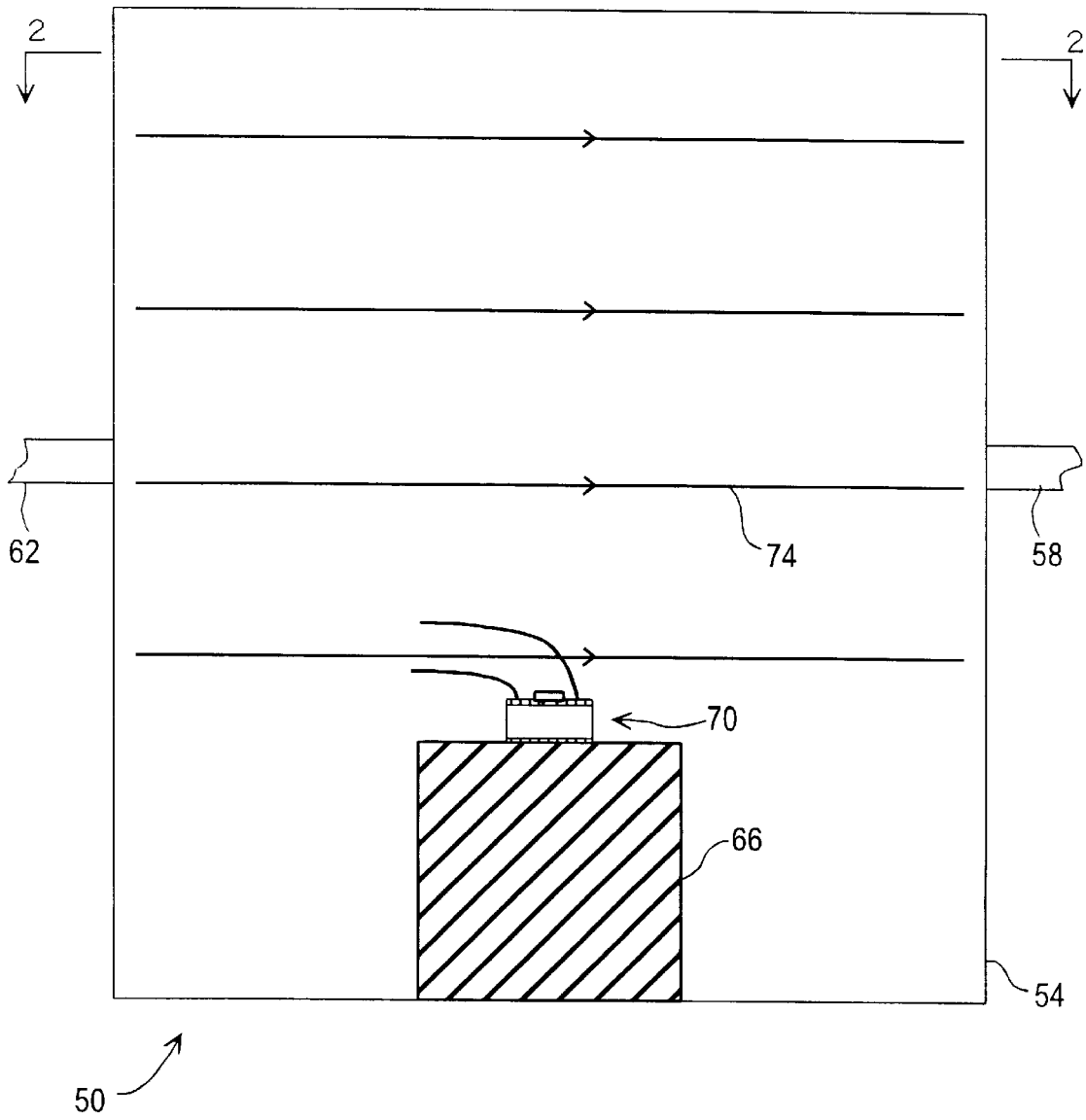
FIG. 1 is a cross-sectional view along line 1—1 of FIG. 2 of an electronically tunable dielectric resonating cavity apparatus according to the present invention.
Figure 2:
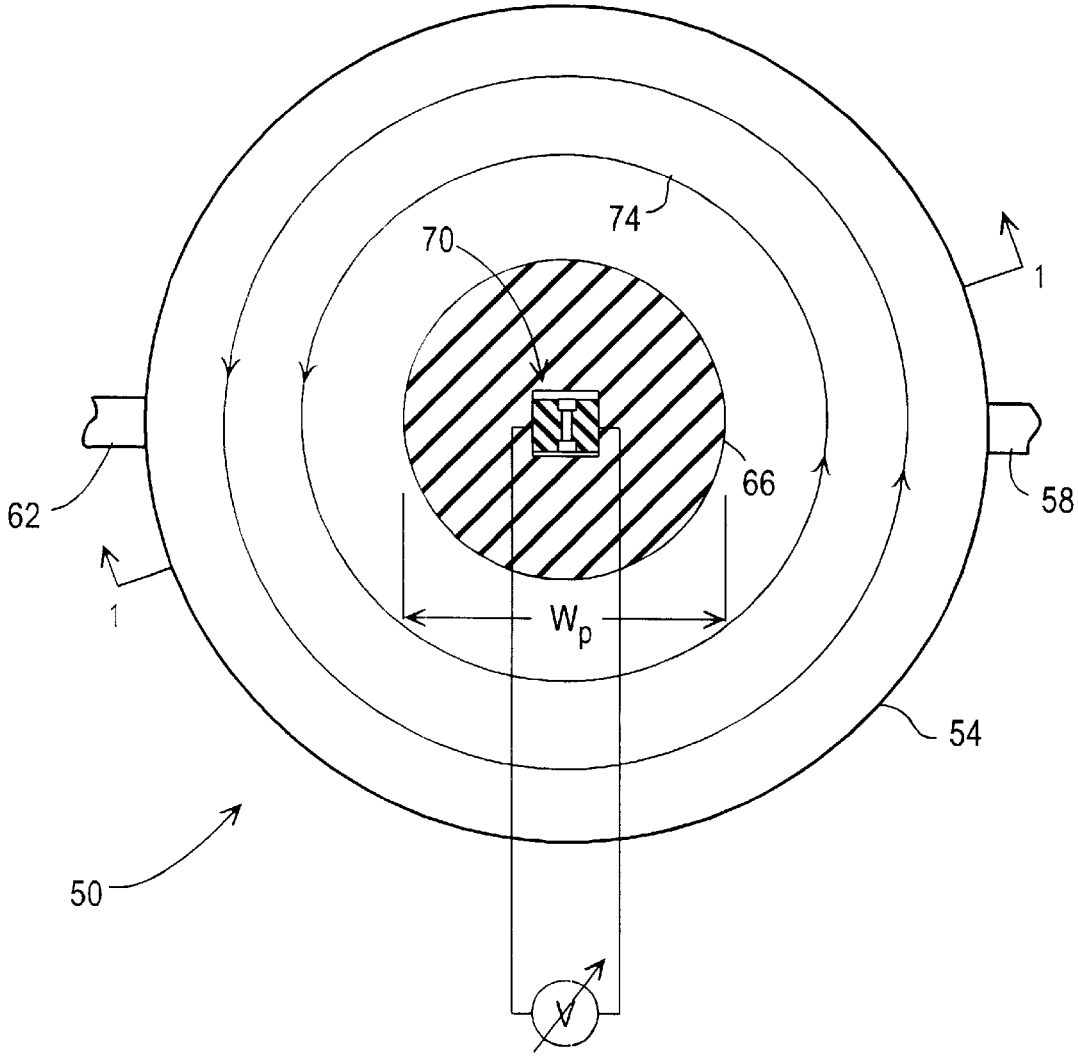
FIG. 2 is a cross-sectional view along line 2—2 of FIG. 1.

FIGS. 1 and 2 depict an electronically tunable dielectric resonating cavity apparatus of the present invention. The apparatus 50 includes a resonating cavity 54 having an input 58 and output 62 for electromagnetic energy, a dielectric block or puck 66, and a resonant circuit component 70 of an electronic tuning device positioned on or near the puck 66. Although the electric field 74 formed by the electromagnetic energy is depicted for the $TE_{01\delta}$ resonating mode, the apparatus can be tuned effectively for other resonant modes.

Figure 3:
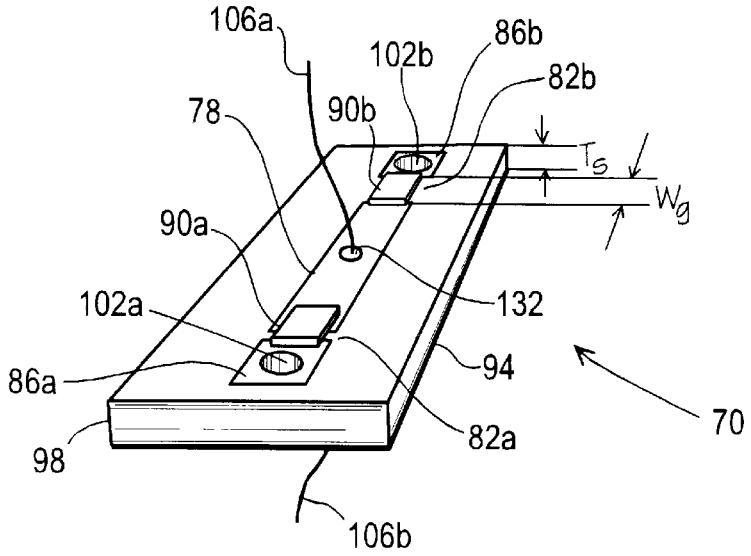
FIG. 3 is a perspective view of a first embodiment of a resonant circuit component of the tuning device of the present invention.

The resonant circuit component 70 is depicted in FIG. 3. The resonant circuit component 70 is configured as a microstrip line resonator. The component 70 includes a transmission line 78 (i.e., a strip of a conductive material) separated by a gap 82*a,* 82*b* from an end conductor 82*a,* 82*b* on either end of the transmission line 78. "Conductive material" refers not only to normal conductors, such as metals, but also to superconductors, such as YBCO, TBCCO and BSCCO. Dielectric varactors 90*a,* 90*b* are located in each of the gaps 82*a,* 82*b* to load either end of the transmission line 78. A ground plane 94 is located on an opposing side of the substrate 98 from the transmission line 78. The end conductors 86*a,* 86*b* are short circuited to the ground plane 94 by means of via holes 102*a,* 102*b*. Bias lines 106*a* and 106*b* are connected to the transmission line 78 and ground plane 94, respectively, to bias the varactors 90*a,* 90*b*. As will be appreciated, the varactors 90*a,* 90*b* could alternatively be imbedded in the via holes 102*a,* 102*b*.

The width "$W_G$" of the each of the gaps 82*a,* 82*b* between the transmission line 78 and the end conductors 86*a,* 86*b* is important to realize a high degree of tuning while maintaining insertion losses at an acceptable level. Preferably, the minimum width of the gaps 82*a,* 82*b* is about 2 microns, more preferably about 5 microns, and most preferably about 10 microns, and the maximum width of the gaps 82*a,* 82*b* is about 100 microns, more preferably about 50 microns, and most preferably about 20 microns.

The dielectric varactor 90 is depicted in FIGS. 4 and 5 for a lumped element configuration. The dielectric varactor 120 includes a self-supporting bulk dielectric material 124 sandwiched between first and second tuning electrodes 128*a,* 128*b* (see FIG. 5) located on opposing sides of the bulk dielectric material 124. The bias lines 106*a,* 106*b* bias the first and second tuning electrodes 128*a,* 128*b,* respectively, and apply a voltage to the electrodes to define the dielectric capacitance between the electrodes 128*a,* 128*b*.

To cause more electromagnetic energy to pass through the dielectric material 124 than the substrate 98, the impedance of the substrate 98 is higher than the impedance of the dielectric material 124. Preferably, the impedance of the substrate 98 is at least about 200% of the impedance of the dielectric material 124. Preferred materials for the substrate 98 include alumina ($Al_2O_3$), magnesium oxide (MgO), lanthanum aluminate ($LaAlO_3$), and neodynium gallate ($NdGaO_3$).

FIG. 6 depicts the RLC circuit diagram for the resonant circuit component 70 when the component 70 is coupled to the electromagnetic energy in the cavity 54. In FIG. 6, $R_a$ represents the resistance across the gap 82*a;* $R_b$ represents the resistance across the gap 82*b;* $C_a$ represents the dielectric capacitance of the varactor 90*a;* $C_b$ represents the dielectric capacitance of the varactor 90*b;* L represents the inductance of the resonating cavity; r and R represent resistances of elements of the resonating cavity; and C represents the capacitance of the resonating cavity; and the inductor $L_0$ represents the transmission line 78. The resonant frequency of the component 70 is determined by the length of the transmission line 78 and the dielectric capacitance.

While not wishing to be bound by any theory, the variance of the resonant frequency of the component 70 when coupled to the electromagnetic energy in the cavity 54 appears to cause a concomittant change in the cavity resonant frequency and/or phase of the electromagnetic energy in the cavity. Tuning of the component 70 is realized via the voltage-dependent dielectric capacitance of the varactors 90*a,* 90*b*, and the change in the resonant frequency of the component 70 is caused by the change in the dielectric capacitance.

While again not wishing to be bound by any theory, the amount of change in the cavity resonant frequency appears to be directly related to the amount of electromagnetic energy in the cavity 54 that can be coupled into the dielectric material. The minimum mutual coupling coefficient between the component and the electromagnetic energy in the cavity 54 is preferably about 0.002 and more preferably about 0.005 and the maximum mutual coupling coefficient is preferably about 0.05 and more preferably about 0.02. As will be appreciated, the electromagnetic energy in the cavity 54 is most strongly coupled into the dielectric material when the resonant frequency of the component 70 is approximately equal to the cavity resonant frequency. Thus, by altering the resonant frequency of the component 70, the amount of electromagnetic energy coupled into the dielectric material (and therefore the cavity resonant frequency) is altered.

There is a tradeoff between high tunability of the cavity resonant frequency by the tuning device and insertion loss. The resonant frequency of the component 70 must be selected such that the required degree of tuning of the cavity resonant frequency is realized while maintaining the insertion loss below an acceptable limit and the physical size of the component as small as possible. A high Q component in the tuning device improves the insertion loss of the cavity 54. In light of the tradeoff, the resonant frequency (preferably the first order resonant frequency) is preferably no less than about 65% of the cavity resonant frequency (preferably the first order cavity resonant frequency), more preferably no less than about 75% of the cavity resonant frequency (preferably the first order cavity resonant frequency) and most preferably no less than about 90% of the cavity resonant frequency (preferably the first order cavity resonant frequency), and preferably no more than about 90% of the cavity resonant frequency (preferably the first order cavity resonant frequency) but no preferably no more than about 135% of the cavity resonant frequency (preferably the first order cavity resonant frequency), more preferably no more than about 125% of the cavity resonant frequency (preferably the first order cavity resonant frequency) and most preferably no more than about 110% of the cavity resonant frequency (preferably the first order cavity resonant frequency).

For optimum tuning of the cavity resonant frequency, the dielectric capacitance of each varactor must be maintained within a specific range. Although the optimum value of the dielectric capacitance depends on the cavity geometry and the cavity resonant frequency, the minimum dielectric capacitance is preferably about 0.01 pf, more preferably about 0.05 pf, and most preferably about 0.10 pf, and the maximum dielectric capacitance is preferably about 50 pf, more preferably about 10 pf, and most preferably about 4 pf.

To realize these relatively low dielectric capacitance values, the area of metallization of the first and second tuning electrodes 128*a* and 128*b* is relatively small. The maximum area of metallization of each tuning electrode is preferably about 0.02 $cm^2$ and more preferably about 0.005 $cm^2$.

The thickness of the transmission line 78 is yet another important parameter to the performance of the tuning device. Preferably, the minimum thickness of the transmission line 78 is about 3 and more preferably about 5 times the skin depth at the operating frequency for the selected conductive material in the transmission line. The maximum thickness of the transmission line is preferably about 0.5 mm and more preferably about 1.0 mm.

Yet other important parameters to tuning device performance are the thickness "$T_s$" (See FIG. 3) of the substrate 98 and the electric permittivity of the substrate 98. Preferably, the thickness of the substrate 98 ranges from about 0.01 cm to about 0.1 cm and more preferably from about 0.02 to about 0.08 cm. The dielectric constant of the substrate 98 preferably is high enough so that the component 70 is physically small enough to fit into the cavity 54. The minimum dielectric constant of the substrate 98 is about 2 and more preferably about 9.

As shown in FIG. 3, to reduce insertion losses due to coupling of the electromagnetic energy in the cavity 54 to the bias lines 106*a,* 106*b*, the bias lines 106*a,* 106*b* are connected to the transmission line 78 and ground plane 94 at voltage node 132 of the resonant circuit component 70. The voltage node position 132 in the component 70 is at the center of the transmission line 78. The voltage node positions are calculated from the dielectric capacitance of the varactor, the characteristic impedance of the transmission line 78, and the resonant frequency. As will be appreciated, little, if any, electromagnetic energy will couple to the bias lines 106*a,* 106*b* when the bias lines 106*a,* 106*b* are connected at the voltage nodes.

To further reduce insertion losses due to coupling of the electromagnetic energy to the bias lines, a capacitor can be connected, preferably in series or in shunt, to one or both of the bias lines 106*a,* 106*b*. The shunt capacitor preferably has a maximum capacitance of about 100 pf and more preferably about 1,000 pf and a minimum capacitance of about 10 pf to about 50 pf. The shunt capacitor is preferably located at the point on the bias line which is approximately a quarter of a wavelength (of the electromagnetic energy in the cavity 54) away from the voltage node 132 to which the bias line is connected. Alternatively, an inductor can be connected, in series or short, to one or both of the bias lines 106*a,* 106*b*. The induction is preferably located at the point on the bias line which is approximately one-half of a wavelength away from the voltage node 132 to which the bias line is connected.

As best seen in FIGS. 1 and 2, the location of the resonant circuit component 70 within the cavity 54 depends upon the distribution of the electromagnetic field 74. The component 70 is preferably positioned at the area in the electromagnetic field 74 where the electric field component of the electromagnetic field 74 is at a maximum. Preferably, the component 70 is located on a surface (top or side surface) of the puck 66 or, if located away from the puck, within a distance of no more than about 10% of the width "$W_p$" of the puck 66 as shown in FIG. 2.

Figure 7:
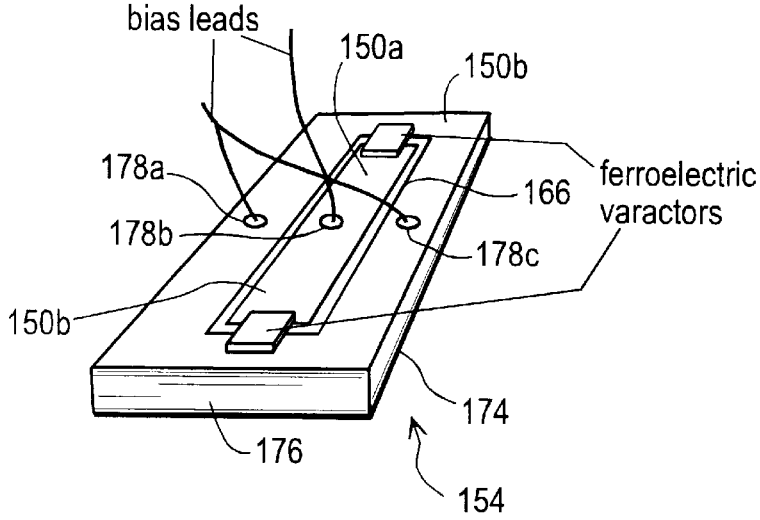
FIG. 7 is a perspective view of a second embodiment of a resonant circuit component of the tuning device of the present invention.
Figure 8:
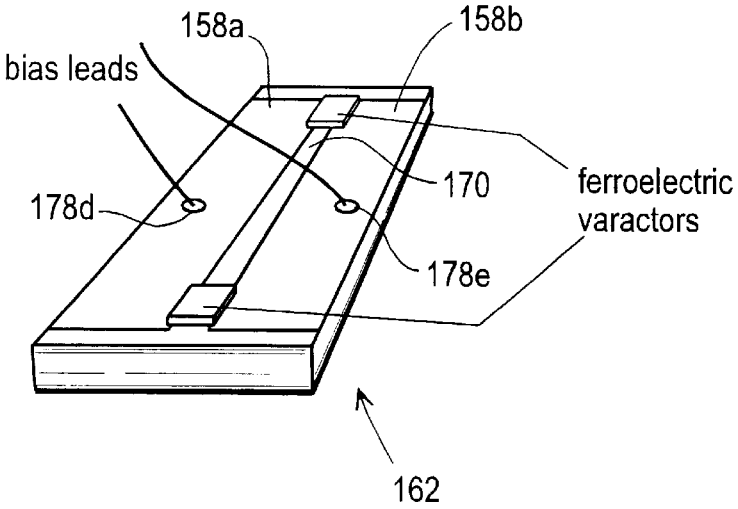
FIG. 8 is a perspective view of a third embodiment of a resonant circuit component of the tuning device of the present invention.

FIGS. 7 and 8 respectively depict a second and third embodiments of a resonant circuit component. The transmission line 150*a,* 150*b* of the resonant circuit component 154 of FIG. 7 is in a coplanar waveguide configuration while the transmission line 158*a,* 158*b* of the resonant circuit component 162 of FIG. 8 is in a slot-line configuration. As noted above, the two sections of transmission line in each component are separated by a gap 166 and 170 respectively in FIGS. 7 and 8, and a pair of ferroelectric varactor are located in the gaps 166 and 170, respectively. The component 154 of FIG. 7 can have a ground plane 174 located on the opposite side of the substrate 176 while the component of FIG. 8 has no ground plane. Neither component has via holes. The component 162 of FIG. 8 typically favors far field coupling to the electromagnetic energy in the cavity 54. The voltage nodes 178*a,* 178*b,* 178*c,* 178*d,* 178*e* in the components 154 and 162 of FIGS. 7 and 8 are located at the respective centers of the corresponding transmission lines 150 and 158 and a bias line is located at each voltage node.

Figure 9:
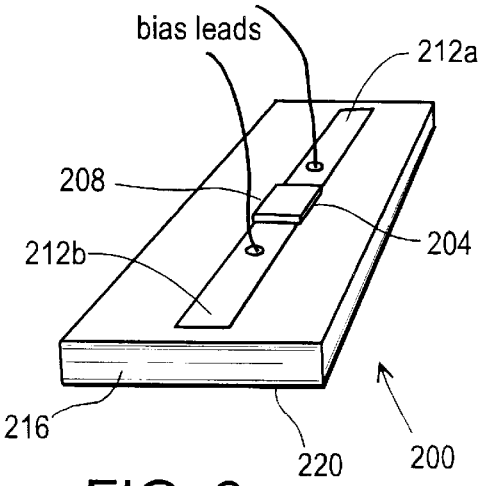
FIG. 9 is a perspective view of a fourth embodiment of a resonant circuit component of the tuning device of the present invention.

FIG. 9 depicts a resonant circuit component 200 configured as an open-ended split resonator in microstrip line with the ferroelectric varactor 204 loading the center gap 208 between the transmission lines 212*a,* 212*b,* all of which is supported by a substrate 216. A ground plane 220 is located on the bottom of the substrate 216. This component 200 differs from the components 70, 154, and 162 of FIGS. 3 and 7–8, respectively in that the component 200 requires only one varactor 204. This structure can be large because each of the transmission lines 212*a* 212*b* has a length that is at least one-half of the wavelength of the electromagnetic energy in the cavity 54.

Figure 10:
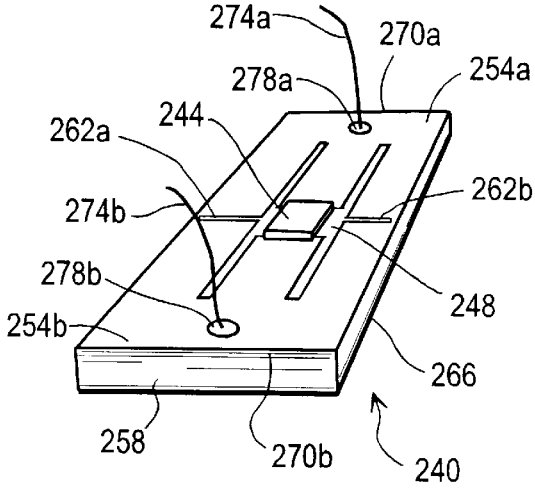
FIG. 10 is a perspective view of a seventh embodiment of a resonant circuit component of the tuning device of the present invention.

FIG. 10 depicts a resonant circuit component 240 configured as a short-ended split resonator in coplanar waveguide with the varactor 244 loading the center gap 248 between the transmission lines 254*a,* 254*b,* all of which is supported by a substrate 258. A DC isolation gap 262*a,* 262*b* is located on each side of the varactor-loaded gap 248 for biasing the ferroelectric varactor 244. An optional ground plane 266 can be located on the bottom of the substrate 258. To make the component 240 physically smaller, via holes (not shown) can be located at either end 270*a,* 270*b* of the component 240 to short circuit the transmission lines 254*a,* 254*b* to the ground plane 266. The bias lines 274*a,* 274*b* are each connected to a voltage node 278*a,* 278*b,* respectively located at the two shorted transmission lines 254*a,b* of the component 240.

As noted above, the resonant frequency of the resonant circuit component is controlled by changing the dielectric capacitance of the varactor. The tuning sensitivity of the component is defined as the percentage tuning of the resonant frequency for the tuner versus the percentage change in the dielectric capacitance. This tuning selectivity also reflects the amount of the electromagnetic energy stored in the transmission line(s) versus the electromagnetic energy stored in the varactors. For the components of FIGS. 3 and 7–8, the larger the dielectric capacitance is for the varactors, the better the tuning selectivity of the resonant circuit component is. With a large dielectric capacitance (i.e., about 10 pf), the tuning sensitivity ranges from about 0.1 to about 0.5. The selection of the dielectric capacitance value manipulates the stored energies in the transmission line(s) and the varactor(s) to obtain a high Q for the component while maintaining a reasonably good tuning sensitivity. The minimum Q for the component is at least about 75, more preferably at least about 150 and most preferably at least about 250. For the components of FIGS. 9 and 10, the tuning sensitivity typically ranges from about 0.05 to about 0.18. There is a specific dielectric capacitance value required to realize the optimal sensitivity of about 0.18. Accordingly, the components of FIGS. 9 and 10 have lower tuning sensitivities than the components of FIGS. 3 and 7–8.

Figure 11:
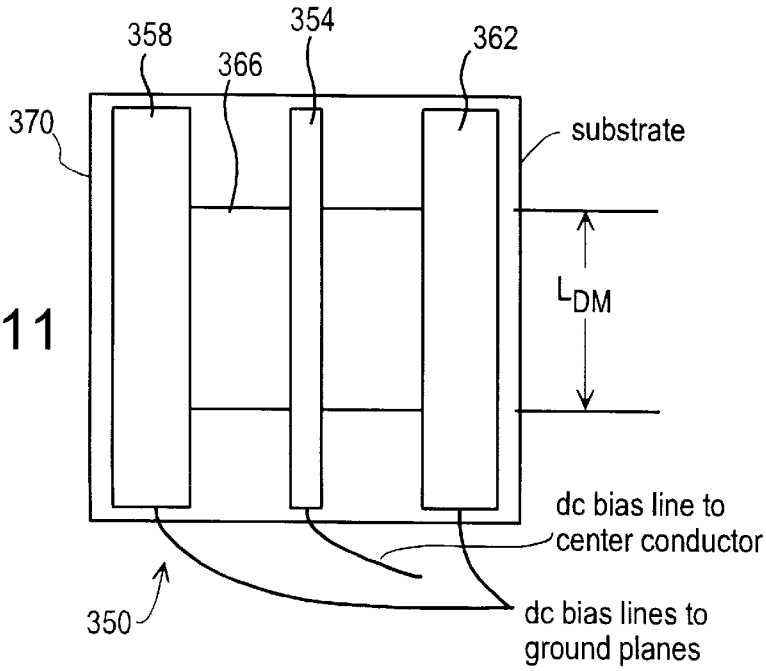
FIG. 11 is a top view of an eighth embodiment of a resonant circuit component of the tuning device of the present invention.
Figure 12:
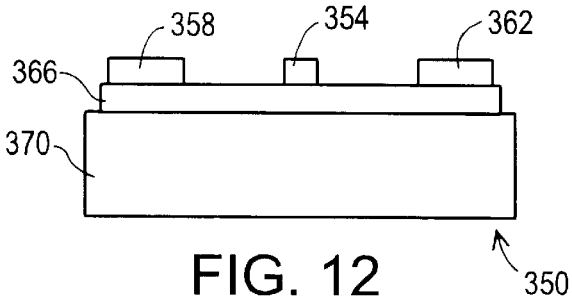
FIG. 12 is a side view of the component of FIG. 11.

FIGS. 11 and 12 depict an embodiment of a distributed element resonant circuit component. The component 350 has a center conductor 354 and two coplanar ground planes 358 and 362 positioned on both sides of the center conductor 354. The center conductor 354 and ground planes 358 and 362 are located above a thin or thick film dielectric material 366 which is deposited on an electrically insulating substrate 370 as seen in FIG. 11. The dielectric material 366 is distributed over a substantial length "$L_{DM}$" of the substrate 370. This length "$L_{DM}$" can vary from about one-eighth of a wavelength to the length of the entire substrate 370. The distributed element component is fabricated by first depositing the dielectric material 366 on a suitable substrate 370, such as lanthanum aluminate, neodynium gallate, aluminum oxide, and magnesium oxide. The substrate 370 must support growth of a low-loss tunable dielectric material, be electrically insulating, and have low losses at the frequency of the electromagnetic energy in the cavity 54. A conductive layer is subsequently deposited and etched to form a resonant circuit with a first order resonance in the vicinity of the cavity resonant frequency. The cavity is tuned by altering the DC bias applied to the dielectric material via bias leads attached to the planar conductors, thus altering the resonant frequency of the component.

A variety of other varactor configurations can be employed in the resonant circuit component. By way of example, FIGS. 13 and 14 depict a second embodiment of a lumped element varactor. The tuning electrodes 450*a,* 450*b* are located on a common surface 454 of the self-supporting bulk dielectric material 458. An advantage of this design is it can significantly lower the dielectric capacitance values of the varactor while maintaining high electric fields (and thus tunabilities) across the gap 462 between the tuning electrodes 450*a,* 450*b*. The gap 462 preferably ranges from about 30 to about 100 microns in width.

FIGS. 15 and 16 depict a third embodiment of a lumped element varactor according to the present invention. The varactor 500 has the tuning electrodes 504*a,* 504*b* deposited on a common surface 506 of a thick film dielectric material 508 which in turn is deposited on an electrically insulating, low electric permittivity substrate 512. The tuning electrodes 504*a,* 504*b* are separated by a gap 516. The substrate 512 preferably has an impedance greater than the impedance of the dielectric material 508. More preferably, the impedance of the substrate 512 is at least about 200% of the impedance of the dielectric material 508. The substrate 512 can be alumina ($Al_2O_3$) or magnesium oxide (MgO).

There are advantages to using a thick film dielectric material compared to a self-supporting bulk dielectric material. Because thick film dielectrics have a thickness (i.e., 1 to 6 mils) that is comparable to the width of the gap 516, fringing of the RF and DC electric fields into the portion of the bulk dielectric material furthest removed from the electrodes is minimized. Because the electric permittivity and thus the electrical susceptance of the thick film dielectric material is much larger than that of the substrate 512, the RF and DC electric fields are concentrated in the thick film dielectric material. For certain frequencies and electromagnetic field strengths, this varactor 500 can therefore have enhanced tuning for a given DC voltage and lower overall capacitance values for the varactors.

The selection of a self-supporting bulk, thick film, and thin film dielectric material in the varactor depends upon the frequency of the electromagnetic energy in the cavity 54 and the electromagnetic field strength. Generally, for frequencies ranging from about 400 to about 800 MHz and/or RF power levels ranging from about 100 to about 1,000 Watts, it is preferable to use a self-supporting bulk dielectric material; for frequencies ranging from about 800 to about 2,000 MHz and/or RF power levels ranging from about 5 to about 100 Watts, it is preferable to use a thick film dielectric material; and finally for frequencies ranging from about 2,000 MHz to about 100 GHz and/or RF power levels ranging from about 0.1 to about 5 Watts, it is preferable to use a thin film dielectric material.

Figure 17:
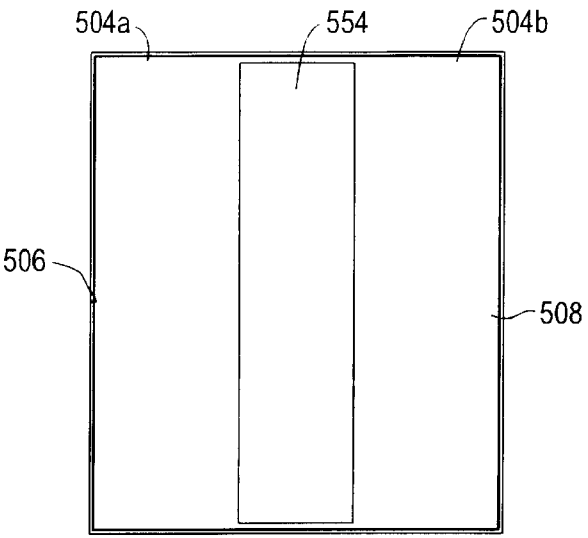
FIG. 17 is a top view of an electronically tunable varactor according to a fourth embodiment of a varactor of the present invention.
Figure 18:
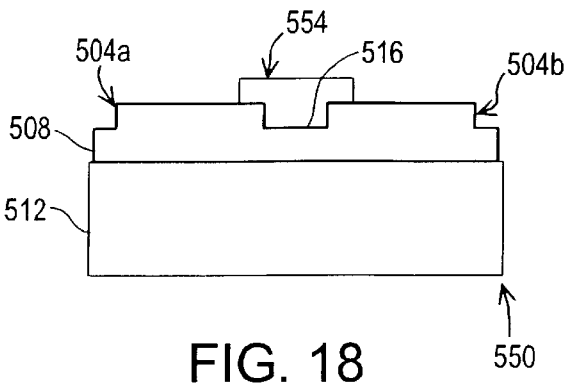
FIG. 18 is a side view of the varactor of FIG. 17.

The varactor 550 of FIGS. 17 and 18 is identical to that of FIGS. 15 and 16 with the exception of an insulating dielectric thick film 554 located in the gap 516 (See FIG. 18) between the tuning electrodes 504*a,* 504*b* and partially covering the electrodes 504*a,* 504*b*. The thick film 554 preferably has a voltage breakdown strength greater than that of air to reduce, compared to the varactor 500 of FIGS. 15 and 16, the possibility of voltage breakdown across the gap 516. The thick film 508 can be a material having a low electric permittivity and loss, such as alumina or magnesium oxide.

Figure 19:
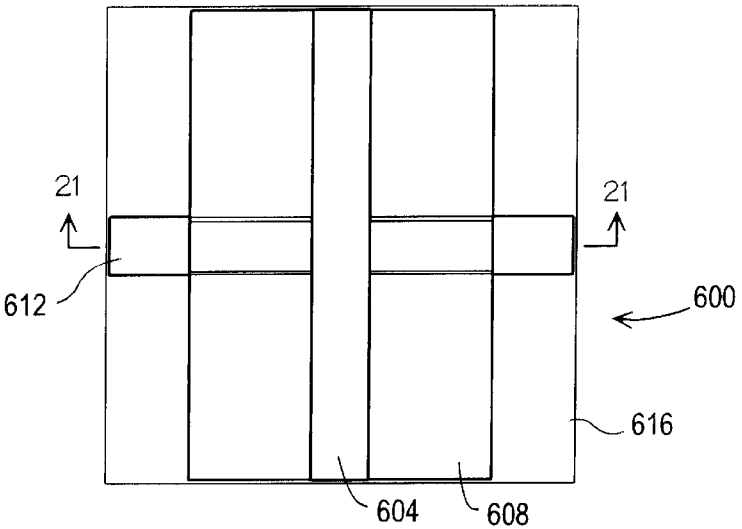
FIG. 19 is a top view of an electronically tunable varactor according to a fifth embodiment of a varactor of the present invention.
Figure 20:
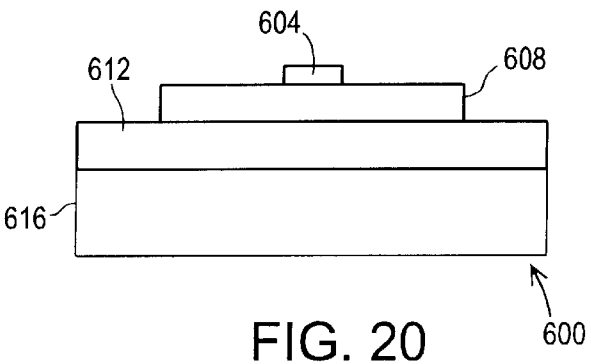
FIG. 20 is a cross-sectional view of the varactor of FIG. 19 taken along line 20—20 of FIG. 19.

FIGS. 19 and 20 depict yet another embodiment of a varactor according to the present invention. The varactor 600 has a patterned tuning electrode 604 atop a thick film dielectric material 608. Another patterned tuning electrode 612 is located below the dielectric material 608. The electrodes and dielectric material are supported by an electrically insulating substrate 616. As will be appreciated, the tuning electrode 612 can be patterned as shown or be a continuous layer covering the entire substrate. Because the dielectric capacitance is concentrated in the volume of the dielectric thick film 608 where the top and bottom electrodes overlap, the dielectric capacitance of this type of varactor can be extremely small (i.e., no more than about 2 pf), and the DC voltage required to tune the dielectric capacitance can kept to modest levels (i.e., no more than about 500 volts).

Figure 21:
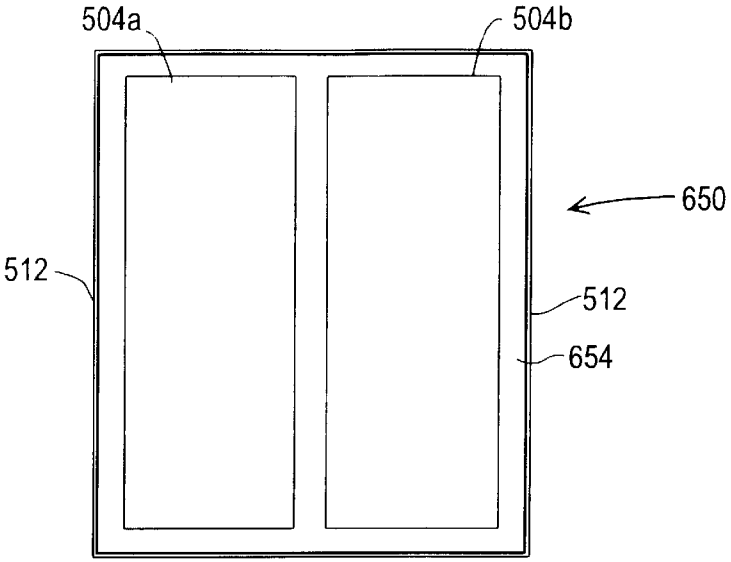
FIG. 21 is a top view of an electronically tunable varactor according to a sixth embodiment of a varactor of the present invention.
Figure 22:
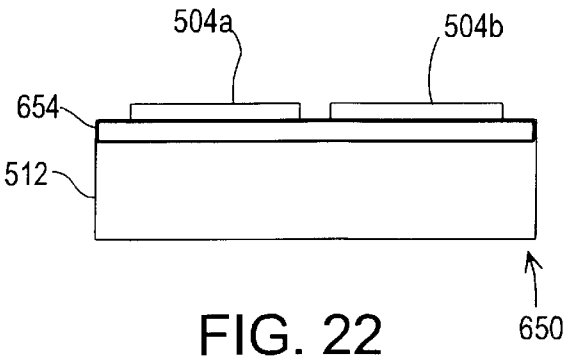
FIG. 22 is a side view of the varactor of FIG. 21.

FIGS. 21 and 22 depict a further embodiment of a varactor 650 using a thin film dielectric material 654 in lieu of the thick film dielectric material 508 in the varactor 500 of FIGS. 16 and 17. The thin film dielectric material 654 (See FIG. 22) has coplanar tuning electrodes 504*a,* 504*b* located on one side and an electrically insulating substrate 512 on the other.

Figure 23:
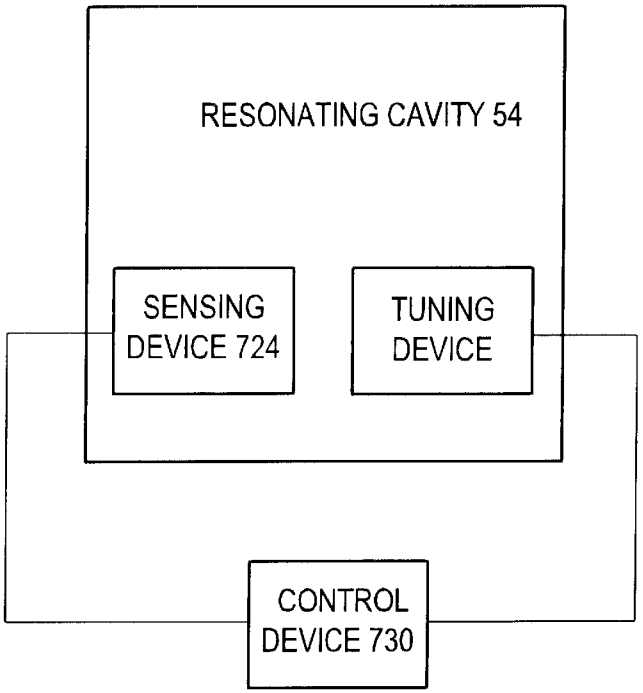
FIG. 23 is a flow schematic of a control feedback loop according to the present invention.

The tuning process employed to yield a selected resonant frequency in the cavity 54 will now be described using the tuning system of FIG. 23. To initiate the tuning process, a selected resonant frequency is first transmitted to the control device 730 which selects a first electric field strength and communicates an appropriate control signal to the biasing source.

The biasing source supplies power to the biasing device which applies a first electric field of the first electric field strength to the dielectric substrate to produce a first mean electric permittivity in the dielectric material. The first mean electric permittivity causes a first cavity resonant frequency to be produced in the resonating cavity 54. The sensing device 724 measures the first cavity resonant frequency and generates a first signal. The control device 730 receives the first signal and generates a first control signal to the biasing source depending upon the difference between the selected resonant frequency and the first resonant frequency. By way of example, if the first resonant frequency is less than the selected resonant frequency, the first control signal will command the biasing source to apply more bias through the biasing device. If the first resonant frequency is more than the selected resonant frequency, the first control signal will command the biasing source to apply less bias through the biasing source.

When the biasing source responds to the first control signal, a second electric field of a second electric field strength is applied to the dielectric material to produce a second mean electric permittivity in the material. The second electric field strength is different from the first electric field strength. The sensing device 724 measures a second cavity resonant frequency that is different from the first cavity resonant frequency and communicates a second signal to the control device 730. The control device 730 communicates an appropriate second control signal to the biasing source which applies bias through the biasing source to produce a third electric field strength in the defined region of the dielectric material.

The above-described steps are repeated until the selected cavity resonant frequency is produced in the resonating cavity. Generally, the time required to produce the selected resonant frequency in the resonating cavity is no more than about $1\times10^{-3}$ seconds and more generally ranges from about $1\times10^{-7}$ to about $1\times10^{-4}$ seconds. The time required to obtain a selected cavity resonant frequency is therefore several orders of magnitude less than the times required by existing tuning techniques.

In selecting an electric field strength, the control device 730 can compare the selected resonant frequency with a predetermined set of values for the resonant frequency which are indexed against a corresponding set of predetermined electric field strengths. The sets can be generated either experimentally or during the operational tuning of the resonating cavity. Where one or more selected resonant frequencies will be used regularly, the sets include the regularly used resonant frequencies and corresponding electric field strengths.

EXPERIMENT 1

Figure 24:
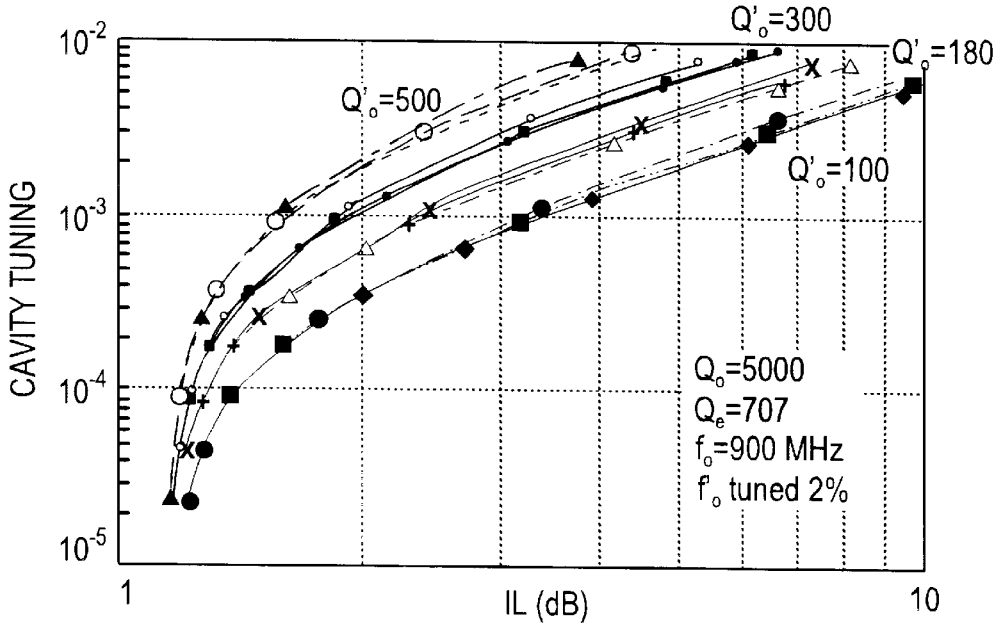
FIG. 24 is a plot of cavity tuning as a function of the insertion loss.

To determine the impact of the unloaded Q of the resonant circuit component on cavity tuning and insertion loss, an experiment was conducted in which resonant circuit components having differing unloaded Q's were used to tune a dielectric resonating cavity. FIG. 24 depicts cavity tuning (vertical axis) as a function of insertion loss ("IL") (horizontal axis) when the cavity is tuned using resonant circuit components with unloaded Q values ($Q_0'$), namely $Q'_0=500$, $Q'_0=300$, $Q'_0=180$, and $Q'_0=100$. "Cavity tuning" is defined as the change in cavity resonant frequency (as a result of tuning) /the initial cavity resonant frequency. The unloaded Q ($Q_0$) of the dielectric resonating cavity is 5,000; the initial cavity resonant frequency ($f_0$) is 900 MHz; the resonant frequency of the resonant circuit component ($f_0'$) is tuned 2% (i.e., the resonant frequency is changed 2% from the initial resonant frequency); and the external Q ($Q_e$) (assuming the resonant circuit component is loss-free) is 707. Accordingly, cavity losses are assumed to be attributable primarily to loading by the external circuit. During the experiment, the resonant circuit component was placed in various positions in the cavity to provide differing mutual coupling coefficients between the component and the oscillating electromagnetic field in the cavity. With reference to FIG. 24, maximum tuning with minimal cavity insertion loss is obtained by increasing the unloaded Q of the cavity resonant circuit component. At the lower end of each curve in FIG. 24, the mutual coupling coefficient was relatively low and the insertion loss relatively low while at the upper end of each curve the mutual coupling coefficient was relatively high and the insertion loss was relatively high.

EXPERIMENT 2

To determine the impact of differing degrees of tuning of the resonant circuit component on cavity tuning and insertion loss, an experiment was conducted in which a resonant circuit component was inserted into a dielectric resonating cavity and subjected to differing degrees of tuning ranging from 1 to 4%; namely 1%, 2%, and. The resonant circuit component had a constant $Q_0'$ of 180. During the experiment, the resonant circuit component was placed in various positions in the cavity to provide differing mutual coupling coefficients between the component and the oscillating electromagnetic field in the cavity.

Figure 25:
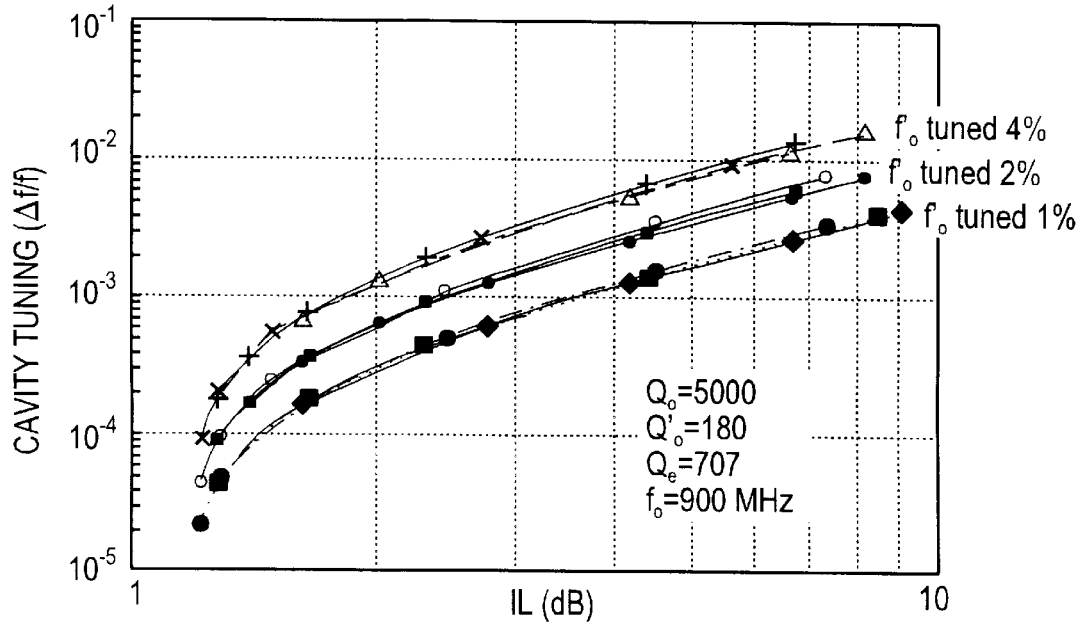
FIG. 25 is also a plot of cavity tuning as a function of the insertion loss.

FIG. 25 depicts cavity tuning (vertical axis) as a function of insertion loss (horizontal axis). As can be seen from FIG. 25, increasing the range of frequencies over which the resonant circuit component is tuned increases the frequency range over which a cavity can be tuned for a given insertion loss. As can also be seen from FIG. 25 and as mentioned above, the mutual coupling coefficient is directly related to the magnitude of the insertion loss.

EXPERIMENT 3

Figure 26:
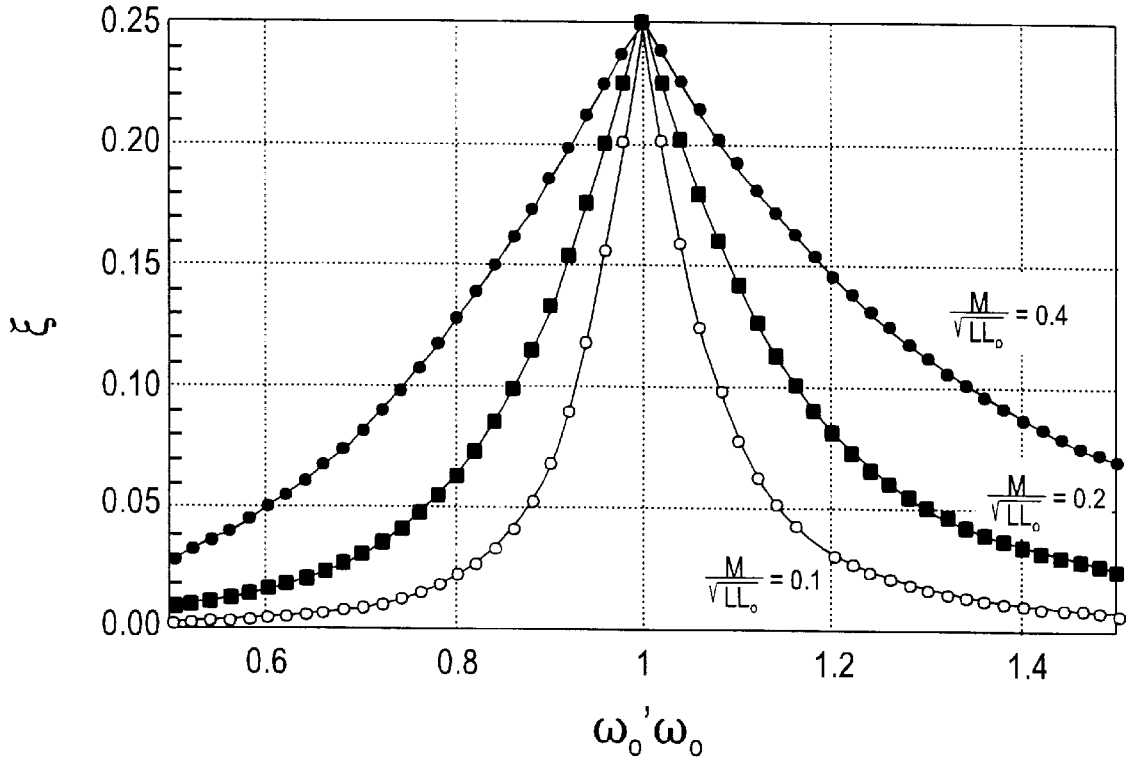
FIG. 26 is a plot of cavity-to-tuner sensitivity as a function of the tuner/cavity resonant frequency ratio.

To determine the relationship between cavity-to-tuner sensitivity to tuner/cavity resonant frequency ratio, a simulation was conducted in which resonant circuit components having differing resonant frequencies were inserted in a dielectric resonating cavity. FIG. 26 depicts the results of the simulation. FIG. 26 plots cavity-to-tuner sensitivity $\Delta\omega_0$(vertical axis) as a function of the tuner/cavity resonant frequency ratio ($\omega'_0/\omega_0$) (horizontal axis). With reference to FIG. 26, M is the mutual coupling coefficient between the cavity and the resonant circuit component; L is the inductance of the cavity; and $L_0$ is the inductance of the resonant circuit component. Based on FIG. 26, the cavity-to-tuner sensitivity ratio is maximized by designing a resonant frequency of the resonant circuit component that is in close proximity to the cavity resonant frequency. The cavity-to-tuner sensitivity is also increased by increasing the cavity-to-tuner coupling ($M/(LL_0)^{0.5}$) from 0.1 to 0.2 and from 0.2 to 0.4.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A tunable electromagnetic resonating apparatus, comprising:

a cavity for resonating at a cavity resonant frequency in response to electromagnetic energy received by said cavity;

an input for inputting said electromagnetic energy into said cavity;

an output for outputting said electromagnetic energy from said cavity;

a resonator coupled to said cavity for altering the cavity resonant frequency, said resonator comprising a dielectric material having an electric permittivity that is a variable function of a voltage applied to said dielectric material, and a pair of spaced-apart conductors, said pair of spaced-apart conductors being located on a common surface of a substrate, the dielectric material being located in a gap between the conductors;

a biasing circuit for applying said voltage to said dielectric material;

a leakage controller for inhibiting coupling of the electromagnetic energy to said biasing circuit, said leakage controller being operatively connected to said biasing circuit;

a sensing device operatively connected to the cavity for determining the cavity resonant frequency and generating a signal in response thereto;

a variable power source connected to said biasing circuit for appylying power thereto; and a control device connected to the variable power source and sensing device for receiving the signal and generating a control signal in response thereto, wherein the variable power source applies power to the biasing circuit in response to said control signal, wherein said cavity resonant frequency is altered by altering said electric permittivity in response to altering of the applied voltage.

2. The apparatus, as claimed in claim 1, wherein:

said cavity comprises a second dielectric material having a substantially constant permittivity during operation of said apparatus.

3. The apparatus, as claimed in claim 1, wherein:

said cavity has a quality factor of no less than about 300.

4. The apparatus, as claimed in claim 1, wherein:

at least a portion of said resonator is positioned inside of said cavity.

5. The apparatus, as claimed in claim 1, wherein:

said biasing circuit applies to said dielectric material a direct current electric field having an electric field strength of no more than about 500 kv/cm.

6. The apparatus, as claimed in claim 1, wherein:

said resonator comprises at least one voltage node, said biasing circuit comprises a conductor, and said leakage controller comprises a connection for said conductor located at substantially the same position as said voltage node.

7. The apparatus, as claimed in claim 1, wherein:

said biasing circuit comprises a biasing conductor and said leakage controller comprises a shunt capacitor connected to said conductor, the shunt capacitor being located one-quarter wavelength of the electromagnetic energy from one of the spaced-apart conductors.

8. The apparatus, as claimed in claim 1, wherein:

a dielectric impedance of said dielectric material is less than a substrate impedance of said substrate.

9. The apparatus, as claimed in claim 1, wherein:

said electromagnetic energy has a frequency ranging from about $3\times10^8$ to about $1\times10^{11}$ Hz.

10. The apparatus, as claimed in claim 1, wherein:

said dielectric mateial is one of Ba, $Sr_{1-x}$ $TiO_3$ where $0\leqq x\leqq 1$; $PbZr_{1-x}$ $Ti_xO_3$ where $0\leqq x\leqq 1$; $LaTiO_3$, $PbZrO_3$; $LaZrO_3$; $PbMgO_3$; $PbNbO_3$; and $KTaO_3$.

11. The apparatus, as claimed in claim 1, further comprising:

a second dielectric matcrial, including at least one of a paraelectric and ferroelectric material, positioned in the cavity at a distance from said dielectric material, said second dielectric material having a second electric permittivity altered by a second biasing circuit for biasing said second dielectric material and altering the second electric permittivity to yield a selected cavity resonant frequency in said cavity.

12. The apparatus, as claimed in claim 11, wherein:

said substrate supports said dielectric material and said second dielectric material.

13. The apparatus, as claimed in claim 1, further comprising:

a dielectric puck located in said cavity and at least a portion of said resonator is supported by said dielectric puck.

14. The tunable electromagnetic resonating apparatus, as claimed in claim 1, wherein:

said dielectric material is a bulk or thin film ferroelctric or paraelectric material.

15. A tunable electromaagnetic resonating apparatus, comprising:

a cavity for resonating at a cavity resonant frequency in response to electromagnetic energy received by said cavity;

an input for inputting said electromagnetic energy into said cavity;

an output for outputting said electromagnetic energy from said cavity;

a resonator positioned inside of said cavity for altering the cavity resonant frequency, said resonator comprising a dielectric material having an elcctric permittivity that is a variable function of a voltage applied to said dielectric material and a pair of spaced-apart conductors, said pair of spaced-apart conductors being located on a common surface of an insulating substrate and each of said pair of spaced-apart conductors being located on opposing sides of said dielectric material, said insulating substrate having a substrate impedance that is greater than a dielectric impedance of said dielectric material;

a biasing circuit for applying said voltage to said dielectric material;

a sensor operatively connected to the cavity for determining the cavity resonant frequency and generating a signal in response thereto;

a variable power source connected to the biasing circuit for applying power thereto; and a controller connected to the variable power source and sensor for receiving the signal and generating a control signal in response thereto, wherein the variable power source applies power to the biasing circuit in response to the control signal, wherein said cavity resonant frequency is altered by altering said electric permittivity in response to altering of the applied voltage.

16. The apparatus, as claimed in claim 15, wherein said substrate impedance is at least about 200% of the dielectric impedance.

17. The apparatus, as claimed in claim 15, wherein said substrate is composed of at least one of $LaAlO_3$, MgO, $Al_2O_3$, and $NdGaO_3$.

18. The apparatus, as claimed in claim 15, further comprising:

a leakage coatoller for inhibiting coupling of the electromagnetic energy to said biasing circuit, said leakage controller being operatively connected to said biasing circuit.

19. A tunable electromagnetic resonating apparatus, comprising:

a cavity means for resonating at a cavity resonant frequency in response to electromagnetic energy received by said cavity means;

an input means for inputting said electromagnetic energy into said cavity means;

an output means for outputting said electromagnetic energy from said cavity means;

resonating means coupled to said cavity means for altering the cavity resonant frequency, said resonating means comprising a dielectric material having an electric permittivity that is a variable function of a voltage applied to said dielectric material and first and second spaced-apart conductors, the dielectric material being located between said first and second spaced-apart conductors and said first and second spaced-apart conductors each being located on a common surface of a substrate;

biasing means for applying said voltage to said dielectric material;

sensing means operatively connected to the cavity means for determining the cavity resonant frequency and generating a signal in response thereto;

a variable power source connected to the biasing means for applying power thereto; and control meeans connectcd to the variable power source and sensing means for receiving said signal and generating a control signal in response thereto, wherein said variable power source applies power to the biasing means in response to the control signal, wherein said cavity resonant frequency is altered by altering said electric permittivity in response to altering of the applied voltage.

20. The tunable electromagnetic resonating apparatus, as claimed in claim 19, further comprising:

a second resonating means coupled to said cavity means for altering the cavity resonant frequency, the resonating means having a first resonant frequency and the second resonating means a second resonant frequency, the first resonating frequency being less than the cavity resonant frequency and the second resonant frequency being more than the cavity resonant frequency.

21. The tunable electromagnetic resonating apparatus, as claimed in claim 19, wherein at least a portion of said resonating means is positioned in a gap between said first and second spaced-apart conductors.

22. The tunable electromagnetic resonating apparatus, as claimed in claim 19, wherein:

said resonating means comprises a ground conductor also supported by said substrate and wherein at least one of said first and second conductors are connected to said ground conductor.

23. The tunable electromagnetic resonating apparatus, as claimed in claim 19, wherein:

said resonating means has a resonant frequency and said resonant frequency is no less tha about 65% of said cavity resonant frequency and no more than about 135% of said cavity resonant frequency.

24. Thc tunable electromagnetic resonating apparatus, as claimed in claim 19, wherein:

said first and second spaced-apart conductors are not in physical contact with one another.

25. The tunable electromagnetic resonating apparatus, as claimed in claim 19, wherein:

said first and scond spaced-apart conductors are configured as one of a microstrip line, slot line, and coplanar waveguide.

26. The tunable electromagnetic resonating apparatus, as claimed in claim 19, wherein:

at least one of said first and second spaced-apart conductors has a minimum thickness and said minimum thickness is at least about 3 times the skin depth at the operating frequency for the conductive material in the conductors.

27. A method for altering a cavity resonant frequency in an electromagnetic resonating apparatus, comprising:

(a) providing (i) a cavity for resonating at a cavity resonant frequency in response to electromagnetic energy received by the cavity, the cavity having an input for inputting the electromagnetic energy into the cavity and an output for outputting the electromagnetic energy from the cavity, (ii) a resonator coupled to the cavity for altering the cavity resonant frequency, the resonator including a dielectric material having an electric permittivity that is a variable function of a voltage applied to the dielectric material and a pair of spaced-apart conductors, said pair of conductors are located on a common surface of a substrate, (iii) a biasing circuit for applying the voltage to the dielectric material, and (iv) a leakage controller for inhibiting coupling of the electromagnetic energy to the biasing circuit, the leakage controller being operatively connected to the biasing circuit;

passing at least a portion of the electromagnetic energy through the cavity and through the dielectric material;

measuring the cavity resonant frequency;

generating a signal based on the measured cavity resonant frequency;

generating a control signal in response to the signal; and altering a voltage applied to the dielectric material by the biasing circuit in response to the control signal to alter the electric permittivity and thereby alter the cavity resonant frequency.

28. The method of claim 27, wherein a dielectric puck is located within the cavity and at least a portion of the resonator is supported by the dielectric puck.

29. The method of claim 27, wherein the cavity includes a second dielectric material having a substantially constant electric permittivity during the passing step and wherein the second dielectric material and the dielectric material are supported by the substrate.

* * * * *